United States Patent [19]

Garcia-Garcia

[11] Patent Number: 4,833,993

[45] Date of Patent: May 30, 1989

[54] ARMY MORTAR SHELL

[75] Inventor: Jose Garcia-Garcia, Vizcaya, Spain

[73] Assignee: Esperanza y Cia., S.A., Spain

[21] Appl. No.: 106,133

[22] Filed: Oct. 7, 1987

[30] Foreign Application Priority Data

Nov. 26, 1986 [ES] Spain ..... 8603188

[51] Int. Cl.[4] ..... F42B 4/12

[52] U.S. Cl. ..... 102/340

[58] Field of Search ..... 102/340, 342, 351, 357

[56] References Cited

U.S. PATENT DOCUMENTS

| | | | |
|---|---|---|---|
| 2,359,814 | 10/1944 | Wauters | 102/340 |
| 2,449,540 | 9/1948 | Albin | 102/340 |
| 3,038,407 | 6/1962 | Robertson et al. | 102/340 |
| 3,491,689 | 1/1970 | Francois | 102/340 |
| 3,498,220 | 3/1970 | Bergman | 102/340 |
| 4,294,172 | 10/1981 | Rauschert et al. | 102/357 |

FOREIGN PATENT DOCUMENTS

| | | | |
|---|---|---|---|
| 1254508 | 1/1961 | France | 102/357 |
| 468618 | 3/1969 | Switzerland | 102/340 |

*Primary Examiner*—Deborah L. Kyle
*Assistant Examiner*—Michael J. Carone
*Attorney, Agent, or Firm*—Lucas & Just

[57] ABSTRACT

An army mortar shell having two sections linked to one another by linkages liable to shear and located to the rear of the sealing band, and where the head of such shell is equipped with a time fuse and inside the shell there are two interlinked chambers containing the charge which is released into the air when said two chambers are separated from one another due to the effect of a cartridge located inside the foremost chamber.

10 Claims, 3 Drawing Sheets

ARMY MORTAR SHELL

Smooth bore projectile shells, of the kind dealt with in this invention and hitherto known, are generally comprised of a projectile that is divided into two parts joined together by pins, of which one (usually the foremost of the two) in the case of illuminating shells, contains the flare, and the other contains the parachute, or they may contain relevant explosive charges.

A cartridge which is ignited by the fire from a time fuse provides the pressure required in order to shear the joining pins between such parts, and to eject the lighted flare away therefrom, whose parachute will, upon unfurling, restrain its fall.

Such is the arrangement which has hitherto been employed in producing this kind of shell, where it is common practice moreover for the joint between the two parts into which the metal case is divided, to be located in front of the seal ring (b) in order to prevent the entry of gases from the breech, and furthermore to prevent the shell from becoming split into two while being fired, through the effect of pressure which might be directly exerted upon the front portion.

The operation of these traditional design shells has always been beset by any one of a number of difficulties such as the flare failing to light, the flare canister becoming detached from the parachute, or the flare being carried in the rearmost body of the shell which, upon being delayed from leaving the shell, allows the rearmost body of the shell to become in the parachute strings.

With mortar shells becoming modernized and capable of attaining greater velocities and ranges, these difficulties are made increasingly acute due to the fact that when the projectile opens up, it comes into high speed contact with a fluid.

The army mortar shell covered by this invention is characterized because it is comprised of a front section and a rear section which are joined together by shear pins located in the area to the rear of the greatest shell diameter, and where said front section contains a first chamber whose rear edge rests upon a seating rim on the rear section, and where said rear section contains a second chamber, both of said chambers being linked together.

It is also characterized because it comprises:

(a) a time fuse positioned at the nose of the front section;

(b) a primary ejection cartridge positioned between the time fuse and the bottom of the first chamber, inside of which there are arranged in succession;

(c) a time delay and a secondary ejection cartridge, where ignition is transmitted successively from time fuse to primary ejection cartridge, and then from time delay to secondary ejection cartridge.

It is also characterized because a cover plate with holes in it for delayed detonation is placed between the load in the first chamber and the secondary ejection cartridge.

It is also characterized because the load contained in the first chamber consists of a flare, to the rear end of which is attached a main parachute. The main parachute is contained in the second chamber and the rearmost end of the main parachute is in turn attached to a speed restraining parachute.

It is also characterized because the loads in the first and second chambers take the form of slow burning smoke producing canisters which are ignited by means of at least one igniter coming from the cover plate and leading through the first chamber and into part of the second chamber.

It is also characterized because the load in the first chamber is in the form of slow burning smoke producing canisters, the load in the second chamber being in the form of at least one red phosphorous canister, their ignition being achieved from a central igniter which comes from the cover plate and leads through the first chamber and into part of the second chamber, at which stage it takes the form of a gainer that is capable of rupturing the walls of said second chamber.

It is also characterized because the load in the first and second chambers consists of red phosphorous pellets mixed with a powdered red phosphorous compound, the ignition of which is achieved by a central igniter which comes from the secondary ejection cartridge and leads through the first chamber and into part of the second chamber, where said igniter possesses sufficient explosive power as to rupture the walls of the first and second chambers.

It is also characterized because the bottom partition in the first chamber and the top partition in the second chamber are comprised of one single movable wall.

It is also characterized because a nozzle connecting the inside of the shell with the outside is positioned near the primary ejection cartridge in the front section.

It is also characterized because in the inside bottom of the rear section, there are provided means for ejecting the contents which comprise a direct/indirect action sliding thruster member acting on the second chamber, and in whose spindle there are provided grooves to accommodate protruding balls which abut against a front wall due to the assembly being under pressure from an operating spring, with said balls being released once the force of the ignition gas overcomes the operating spring.

It is also characterized because said first and second chambers are linked to one another by means of a mutual locking seam in the form of a strong intermediary ring.

The general theoretical basis which applies in particular to the flare shell, is as follows:

(a) the division between the front and rear section is positioned as far as possible towards the rear of the shell, and the mass of its front section is kept as low as possible.

Thus considering the quantity of motion theorem and the principle that the center of gravity of the body follows the trajectory of the shell, we have $m_o x \Delta V_o + m_c x \ \Delta V_c = 0$, whence $(\Delta Vc/\Delta Vo) = (-mo/mc)$, and hence $-\Delta V_c = \Delta V_o$ mo/mc which proves that the decrease in velocity suffered by the rear section becomes greater as the mass of the front section ($m_o$) increases and the mass of the rear section ($m_c$) decreases.

This means that if the division between the front and rear section is positioned behind seal ring a very much greater load emergence remaining velocity reduction is achieved now where the load comprises the flare and parachute than was the case previously and this is true to the extent that it is almost double for a given cartridge load.

(b) the use of delayed initiation has the advantage of avoiding ignition thrust usually experienced with ordi nary shells, which means that once the shell has split into two, and the parachute has started to be ejected from the rear section, the thrust derived from the ignition of the flare, which may still not have fully emerged from the rear section, causes the parachute pack to become rein serted into the rear section with a likelihood of deformations being caused by this uncontrolled rear section, and hence there is possible incorrect operation.

Moreover, such delay in the ignition means that the lighting up of the flare independently from ignition of the ejection cartridge is of sufficient power and heat to ensure that such ignition takes place correctly and safely, and totally regardless of said ejection cartridge.

(c) the employment of the speed restraining parachute has the advantage of preventing the enormous tug which occurs on ordinary shells when the main parachute unfurls and the velocity is high, this often causing breakage of the anchoring rope or chain, and the flare load becoming segregated.

In the case of the shell covered by this invention, such velocity is reduced by a small restraining parachute acting before the main parachute unfurls, and the size of same is such as to ensure that the descent of the lighted flare takes place at the desired speed.

In certain cases, the restraining parachute may be omitted because when the flare pack is projected out of the shell, it itself experiences a restraining effect, and at the same time turns over, which means that its velocity has decreased by the time the parachute is ejected.

Figure 1:
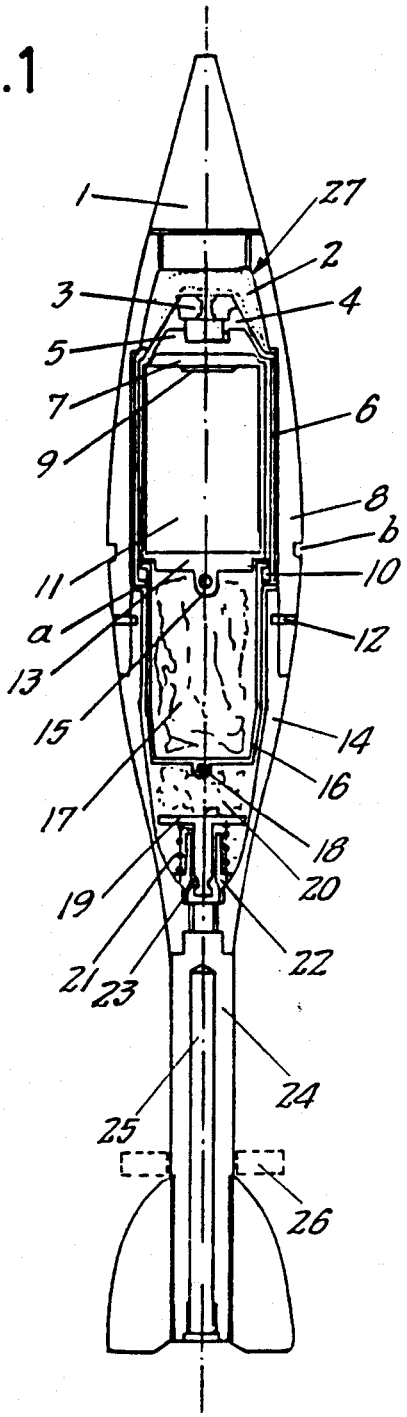
FIG. 1 is a cross section elevational view of the shell with the flare devices.

An examination of FIG. 1 will reveal that the shell is comprised of a spindle shaped body with a tangent concave-convex profile and is formed by a front section (8) and a rear section (14) that are joined together by pins (12).

Said front section terminates in a time fuse (1), whilst the rear section embodies the stabilizing tail (24), the inside of which accommodates projection cartridge (25) which acts as an igniter for external supplementary charges (26).

Within the front section, there is contained a front cylindri cal chamber (6) with a bottom (4) onto which are coupled the delay (3) and the second ejection cartridge (5).

Rear chamber (16) is a cylindrical truncated cone shaped chamber provided within the rear section on the bottom of which is (18) for securing the restraining parachute (20).

Inside the front cylindrical chamber (6) is housed flare (11), upon the front of which is fitted a cover plate (7) having holes in it for the purpose of facilitating the delayed ignition of the contents (a) of the front section of the flare.

An eyed lug (15) is provided on the rear of the flare, where it is secured to the thick bottom of the flare container (13) for the purpose of attaching the main para chute (17).

Within the rear cylindrical-tapered chamber (16) is stowed the main parachute (17) in a properly furled condi tion.

The two aforementioned chambers, that is to say, the front one (6) and the rear one (16), are linked together by means of a heavy intermediate steel ring (10), the purpose of which, as is well known is to prevent deformation on the edge of the rear chamber (16) during its detachment.

The primary ejection cartridge (2), which produces the initial opening of the shell, is located inside the head in front of the bottom (4) of the front chamber (6).

The restraining parachute (20) is secured to eyed lug (18) and stowed in the rear section (14) behind the bottom of the rear chamber (16).

To the rear of the restraining parachute is located the ejection device formed by the thruster (19), spring (21), and guide pieces (22) with the trapped balls (23), and which ensures that the restraining parachute (20) is ejected from the rear section (14).

Balls (23) are pressed, through the force exerted by spring (21), against the wall of guide pieces (22), thus preventing the thruster (19) from moving upwards.

Operation is as follows:

When firing takes place, projection cartridge (25) detonates supplementary charges (26), and the pressure caused in the breech of the weapon ejects the projectile from the barrel, whereafter it describes the trajectory calculated in accordance with the range tables.

Upon expiration of the time delay period that has been previously set on the fuse (1), this will detonate the primary ejection cartridge (2) whereupon two things happen at once:

the time delay (3) is ignited, and a pressure is created in the front chamber occupied by said cartridge (2).

The pressure created in the front chamber thrusts the front section and time fuse forwards, and the bottom (4) of the front cylindrical chamber 96) backwards, the force of which is transmitted through the package formed from said cylindrical chamber (6) and flare (11) to the front seating edges (a) of rear section (14), which causes pins (12) to shear and the shell to divide into two halves:

the front half comprised of the front section (8) and the time fuse (1), which is propelled forwards, increasing the remaining velocity at which the center of gravity of the projectile was at that time travelling;

the rear half comprised of all the remainder of the shell, which is propelled rearwards, decreasing the remaining velocity at which said center of gravity was then travelling.

Once the rear half has been expelled and when the acceleration and air resistance reach a suitable value, the thruster (19), which has been released since the beginning of the shot due to the recoil from same, overcomes the pressure exerted by spring (21), and the subsequent release of balls (23) allows their spring (21) to cause the segregation of the rear section (14) together with its tail (24), of the restraining parachute (20), and the packa ge formed by the front cylindrical chamber (6) and the rear cylindrical truncated conical chamber (16) linked together and holding their complete charge.

The package formed by the two chambers (6) and (16) and their contents, becomes isolated from the remains of the projectile, and is restrained by the small parachute (20) which reduces the remaining velocity of the package down to the velocity limit of such parachute.

If it is considered that the ejected package is now suspended from the restraining parachute (20), it must be remembered that the time delay (3) which was ignited by the gases from the primary ejection cartridge, will, upon reaching the end of its time delay, cause ignition of the secondary ejection cartridge (5) located in the bottom (4) of chamber (6), and the pressure thus created will thrust said chamber (6) rearwards against the cover plate (7) of the flare (11), while at the same time, said gases will, upon going through the holes in the cover plate (7), initiate the delayed ignition of the flare (11).

As the result of the pressure created by the secondary ejection cartridge (5), the linkage on the cylindrical chamber (6) will give way against the resistance of the strength ring (10), and whilst said cylindrical chamber (6) is ejected forwards, the restraining parachute (20) pulls the rear cylindrical truncated conical chamber (16) from the main parachute (17), and this latter is thus left free in its attachment to the flare, whereupon it unfurls and descends at the velocity limit of about 4 m/second.

Meanwhile, flare (11) becomes fully live and begins its illumination period.

A nozzle (27), with a plug to stop it, is provided on the front section (8) in the region of the primary ejection cartridge, the effect of which is to create a des tabilizing torque due to gases being exhausted therethrough and this causes the shell axis to become out of alignment with the tangent of its trajectory, and as the various parts are shed from the shell, this will prevent the rear parts from reaching the live package or becoming entangled in the main parachute strings.

Figure 2:
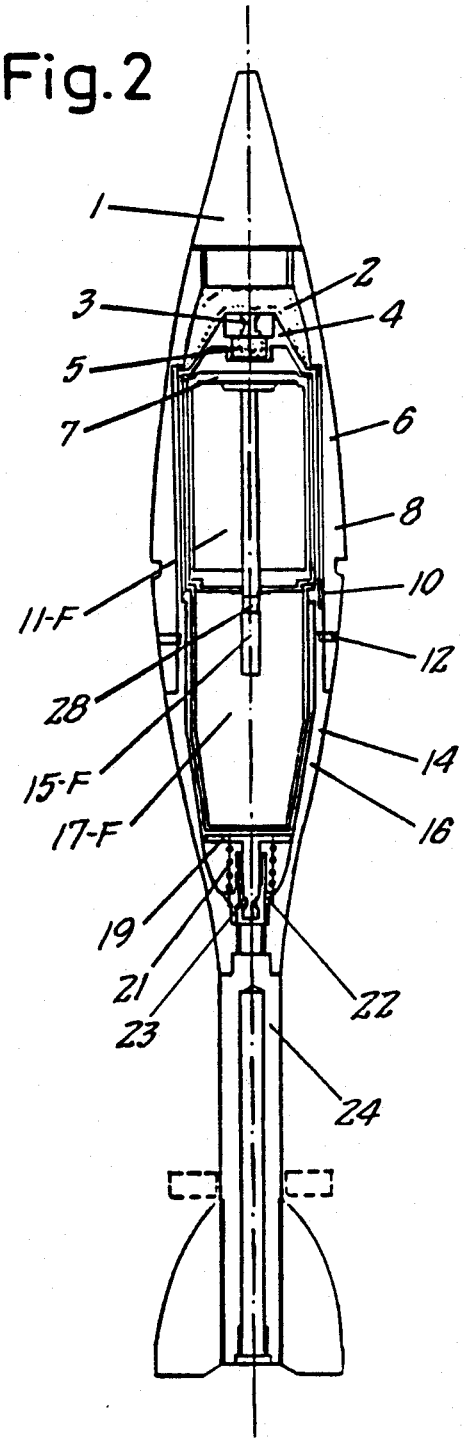
FIG. 2 is a cross section elevational view of the shell as equipped for prolonged smoke emissions.

FIG. 2 illustrates the position with respect to prolonged smoke emission operation.

For this purpose, the illuminating flare (11) is replaced by the smoke emitting device which is set up from one or more cylindrical canisters (11-F) arranged for central ignition and loaded with a slow burning smoke producing compound, such as zinc hexachloroethane powder, zinc oxide or a similar mixture.

Instead of holding parachute (17), the rear section (14) will likewise have a smoke producing charge (17-F) of the same kind, and there will be no restraining parachute.

Operation could either be by means of a proximity fuse, a time fuse or a delayed action fuse, and would take place as follows:

Time fuse (1) ignites the primary ejection cartridge (2) which by means of the system described above, causes the time delay (3) to ignite and pins (12) to shear, whereupon the shell breaks into two, one portion being the fuse (1) and front section (8), and the other being the remainder of the shell.

Due to the action of the ejection mechanism (19), (21), (22), (23)explained above the package comprised of the two linked containers (6), (16) will become detached from the rear section (14) and tail (24).

After the smoke producing package has been ejected and the time delay (3) has elapsed, this will ignite the secondary ejection cartridge (5) which, once the bottom (4) of chamber (6) has been thrust forward and the hold cover plate (7) has been thrust rearwards, will bring about the release of the linkage between chambers (6) and (16), and simultaneously the ignition of smoke canisters (11-F) and (17-F) which upon becoming detached, fall towards the ground while burning, and produce a long lasting smoke cloud from various emission point.

If a high explosive proximity or time fuze is employed, the smoke canisters will be spread out over a wide area when landing.

If instead of the proposed hexachloroethane compound, red phosphorous pellets are inserted in the rear chamber with a binding compound with delayed ignition and igniter (15-F) for ignition and rupture of the container (16) as it is also illustrated in the drawing, final operation will be as follows:

Once the package has been ejected by the aforementioned mechanisms and the secondary cartridge (5) activated, all canisters of hexachloroethane (11-f) are ignited causing a prolonged emission, meanwhile the rear canister filled with red phosphorous (17-F) is activated by its gainer (28), breaks the casing around the rear chamber 916), and produces an instantaneous red phosphorous cloud emission spread by the ejected pellets, and this lasts as long as the prolonged emission from the hexachloroethane canisters.

After the package contained in the two linked chambers (6) and (16) has been expelled, and the time delay (3) has elapsed, the secondary ejection cartridge (5) will be brought into action.

As before, the secondary ejection cartridge (5) has dual action, and on the one hand it releases the linkage on ring (10) to expel the canisters of hexachloroethane (11-F) and the delayed action red phosphorous canister (17-F), while moreover they are all ignited simultaneously by igniter (15-F), which is a tube with a row of holes an a suitable charge.

The result is an instantaneous cloud produced by the red phosphorous being spread out by the pellets expelled from said substance, and held over the ground by the prolonged emission hexachloroethane canisters.

Figure 3:
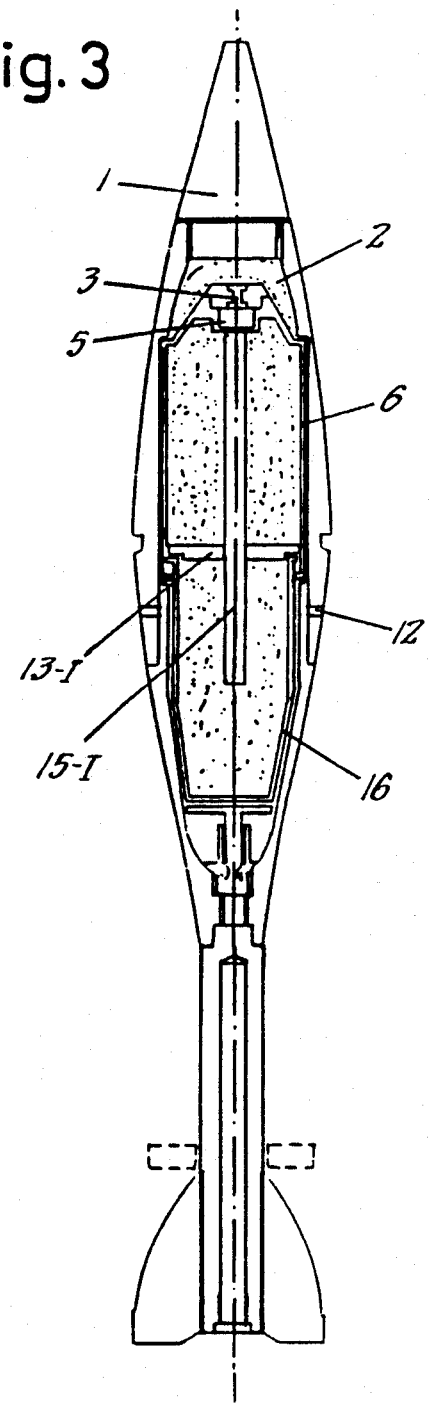
FIG. 3 is a cross section elevation view of the shell as equipped for instantaneous smoke emission.

FIG. 3 illustrates the shell in an arrangement for instant action red phosphorous smoke emissions.

If the unit comprised of linked cylindrical chambers (6) and (16), or cylindrical chambers in a single unit, are filled with compressed red phosphorous pellets with a binder, and these pellets are in turn mixed with a powdered red phosphorous compound having an igniter to provide heat for the proper initiation of the unit, the shell can be arranged for instantaneous smoke action.

Although in this case the smoke canister is really one only, the system described divided into two interlinked portions with a strong cover plate (13-I) in between to segregate them is advantages inasmuch that it withstands firing inertia forces better.

The igniter in this case is long, as depicted by igniter-gainer (15-I).

Operation is as follows:

Fuse (1) ignites the cartridge (2) which causes pins to rupture and the front section (8) and time fuse (1) to be thrust forwards as always, and the rear section 914), tail (24, and the live package comprised of linked sections (6) and (16) both, to be thrust backwards separately for the reasons explained above.

At the end of the required time delay period, the time delay activates the secondary ejection cartridge (5) which in turn activates the modular gainer (15-I) which by rupturing the containers (6) and (16), will make a red phosphorous cloud form, and the cloud is spread by the projection of the pellets in the same charge.

The gainer (15-I) used with the smoke emitting charges may be of whatever nature is considered suitable in accordance with conventional knowledge possessed about similar and conventional products for the purpose of achieving in practice the above described or similar effects.

I claim:

1. An army mortar shell comprising:

(a) a front section, said front section having a nose at one end and a mating area at the other end;

(b) a rear section, said rear section having a tail at one end and a mating area at the other end, said front section mating area mating with said rear section mating area, said rear section having a seating rim positioned at said other end of said rear section;

(c) a shear pin for joining said front section to said rear section when said rear section mating area is mated with said front section mating area;

(d) a first walled chamber housed in said front section, said first walled chamber having a bottom at one end and a rear edge at the other end, said rear edge resting on said seating rim of said rear section;

(e) a second walled chamber housed in said rear section;

(f) means for linking said first walled chamber with said second walled chamber;

(g) a time fuse positioned in the nose of said front section;

(h) a primary ejection cartridge positioned between said time fuse and the bottom of said first walled chamber, said primary ejection cartridge for separating said front section from said rear section; and (i) a time delay and a secondary ejection cartridge positioned in said bottom of said first walled chamber such that ignition is transmitted successively from the time fuse to the primary ejection cartridge, and then from the time delay to the secondary ejection cartridge, said secondary ejection cartridge for affecting separation between said first and second walled chambers.

2. The army mortar shell of claim 1 further comprising a cover plate with holes in said plate for delayed detonation, said plate spaced between a load housed in the first walled chamber and the secondary ejection cartridge.

3. The army mortar shell of claim 2 wherein the load contained in the first walled chamber consists of a flare, said flare having a rear end to which is attached a main parachute, said main parachute contained in the second walled chamber and said second walled chamber attached to a speed restraining parachute.

4. The army mortar shell of claim 2 wherein the first and second walled chambers house slow burning smoke producing canisters which are ignited by means of at least one igniter extending through the first walled chamber and into part of the second walled chamber.

5. The army mortary shell of claim 2 wherein the load in the first walled chamber is in the form of slow burning smoke producing canisters, and the load in the second walled chamber has at least one red phosphorous canister, the ignition of said canisters being achieved from a central igniter which comes from the cover plate and leads through the first walled chamber and into part of the second walled chamber, said igniter taking the form of a gainer that is capable of rupturing the walls of said second walled chamber.

6. The army mortary shell of claim 1 wherein the first and second walled chambers house red phosphorous pellets mixed with a powdered red phosphorous compound, the ignition of which is achieved by a central igniter which extends from the secondary ejection cartridge through the first walled chamber and into part of the second walled chamber, where said igniter possesses sufficient explosive power as to rupture the walls of said first and second walled chambers.

7. The army mortar shell of claim 6 wherein the first walled chamber and the second walled chamber are partitioned by a single movable wall.

8. The army mortar shell of claim 1 further comprising a nozzle connecting the inside of the shell with the outside, said nozzle positioned in close proximity to the primary ejection cartridge in the front section.

9. The army mortar shell of claim 1 further comprising a sliding thruster member housed in said rear section, said thruster member acting on the second walled chamber, said thruster member having a spindle provided with grooves to accommodate protruding balls which abut against a front wall due to an operating spring, said balls being released once the force of ignition gas overcomes the operating spring.

10. The army mortar shell of claim 1 wherein said first and second walled chambers are linked to one another by means of a mutual locking seam in the form of a strong intermediary ring.

* * * * *